United States Patent [19]

Väänänen

[11] Patent Number: 4,567,920

[45] Date of Patent: Feb. 4, 1986

[54] FORCE METHOD OF AND APPARATUS FOR TRICKLING SILOED MATERIAL FROM A SILO

[76] Inventor: Olavi Väänänen, Porttikuja 2 F 68, 00940 Helsinki 94, Finland

[21] Appl. No.: 554,635

[22] Filed: Nov. 23, 1983

[30] Foreign Application Priority Data

Nov. 29, 1982 [FI] Finland ..... 824095
May 27, 1983 [FI] Finland ..... 831894

[51] Int. Cl.[4] ..... B65B 1/04

[52] U.S. Cl. ..... 141/1; 141/11; 141/82; 141/98; 141/331; 222/459; 222/564; 414/298; 414/299; 414/317

[58] Field of Search ..... 141/1, 392, 2–12, 141/37–70, 82, 98, 331–345; 414/298, 299, 317; 222/564, 547, 459, 146.1, 146.2, 146.3, 146.4

[56] References Cited

U.S. PATENT DOCUMENTS 1,731,675 10/1929 McCoy ..... 222/459

FOREIGN PATENT DOCUMENTS 367804 10/1974 Sweden .

*Primary Examiner*—Houston S. Bell, Jr.
*Attorney, Agent, or Firm*—Kenyon & Kenyon

[57] ABSTRACT

A force method of and assembly for trickling rock material from a silo. The bottom part of a silo is provided with a vaulting element and a pressure force is generated in a vaulting chamber or closed space below the vaulting element. For optimum trickling action, the forces facilitating trickling are concentrated on a vertical that extends through a trickling or draining outlet by mounting an upright friction plate for eliminating a frictional force and by directing a pressure force and a thermal force or power, which adds to the pressure force, on the same vertical through the trickling outlet along which the linear motion of a point of material occurs.

9 Claims, 3 Drawing Figures

FORCE METHOD OF AND APPARATUS FOR TRICKLING SILOED MATERIAL FROM A SILO

The invention relates to a force method for the elimination of a frictional force inhibiting trickling of siloed material and for the increase of trickling action induced by gravity.

In the prior art, the trickling problems have been analysed by studying angles of repose or so-called ellipsoids formed by moving rock material. Among other things, it has been found that a siloed material of varying coarseness forms different angles of repose. The problem has been impossible to solve as the number of angles of repose or roller angles is limitless. In other words, this analysing method has been misleading as the number of roller angles and so-called ellipsoids is in practice limitless and often ends up in a roller angle over 90° when rock material becomes vaulted and trickling stopped.

The prior art studies ignore the basic laws of mechanics, i.e. the effect of forces on motion. Thus, the prior art studies have not resulted in the discovery of the most accurate position of forces which accomplish trickling.

In the invention, a solution to the problem is based on the application of the basic laws of Newton classical mechanics. (1) Each body stays in rest or in uniform linear motion unless some force forces it to alter its kinetic state. (2) The alteration of motion is proportional to the active force and it occurs in the direction of a line the force acts in. (3) The forces directed to two bodies acting on each other are equal but opposed to each other.

In siloed material, gravity and frictional force act opposite to each other. When the siloed material trickles, frictional force is also opposed by the kinetic force or intermediate force possessed by siloed material. Thus, the following equation can be written $$\text{gravity} + \text{intermediate force} = \text{frictional force.}$$

When siloed material trickles out of a silo, the intermediate force or kinetic force remains constant. On the other hand, gravity and frictional force decrease at the same rate the amount of siloed material decreases.

In the 1st law of Newton mechanics, the above-mentioned "some force" is a force that disturbs from the outside the static or kinetic state of a body.

When rock material does not trickle out of a silo, an additional force is required to change the resting kinetic state. Previously, the only practical additional force has been "a stick as an extension of the arm". It has been obvious that, when having a stick as an extension of the arm, the work has been carried along the vertical running through a trickling outlet. Until now, it has not been realised that all other trickling promoting additional forces must be focused the same way on the vertical running through a trickling outlet.

A flow passage for siloed material having the lowest resistance to motion always lies at a trickling outlet. In the study, it is necessary to separate the point of material on the vertical extending through the center of a trickling outlet from the rest of siloed material. Trickling of a siloed material is not possible unless the point of material is the winner in the race between itself and a siloed material. The increase of frictional force between the point of material and a siloed material, e.g. due to moisture, prevents trickling.

According to the invention, it has been discovered that the increased frictional force between a point of material on the vertical and a siloed material must be eliminated in order to keep the point of material and thus the siloed material in uniform linear motion along a vertical running through the trickling outlet.

The basis of the invention is that, in order to accomplish trickling, the flow must be achieved by means of additional forces which are concentrated on this vertical flow passage extending through the trickling outlet and having the lowest resistance of flow. Fresh material is supplied into the flow passage mainly from the top portion of the passage, so the only action in the bottom section of a silo is to apply additional forces for stopping the blockage of the flow passage. For this reason, according to the invention, all flow-promoting additional forces are concentrated in the bottom section of a silo on a vertical extending through the trickling outlet and along which the linear movement of a point of material proceeds.

In one embodiment, the frictional force within the siloed material is eliminated by means of a friction plate which is substantially aligned with gravity and the pressure force and which is positioned in a trickling funnel. The trickling action induced by gravity is increased by means of a pressure force generated in the space below a vaulting means mounted above the friction plate. This pressure force is created by air under pressure and steam which are delivered via pressure lines into a vaulting space below the vaulting means.

In another embodiment, reliance may be made on gravity alone for trickling the siloed material. In this case, no vaulting means is disposed within the silo in association with the source of pressure force. These are unnecessary, for example, when rock material which is used as the siloed material is not heated, for example, for the production of hot concrete.

By means of this method and assembly it has been possible to eliminate the frictional force above the trickling outlet in an effluence cone which force resists the trickling of rock material. The transition point between the effluence cone and a silo is called X-axis. It is now also possible to eliminate the frictional force above this X-axis, since the frictional force below the X-axis has been eliminated first, meaning that the increase of gravitational trickling action above the X-axis is now useful. If the frictional force above the X-axis had been eliminated first, the frictional force below the X-axis would have increased with a result that siloed material would have jammed in the effluence cone of a silo even more effectively than before.

According to the invention, frictional force is decreased and thus the gravitational trickling action increased substantially by means of a gravitationally directed friction plate even above the X-axis in a silo.

These and other objects and advantages of the invention will become more apparent from the accompanying drawings wherein.

Figure 1:
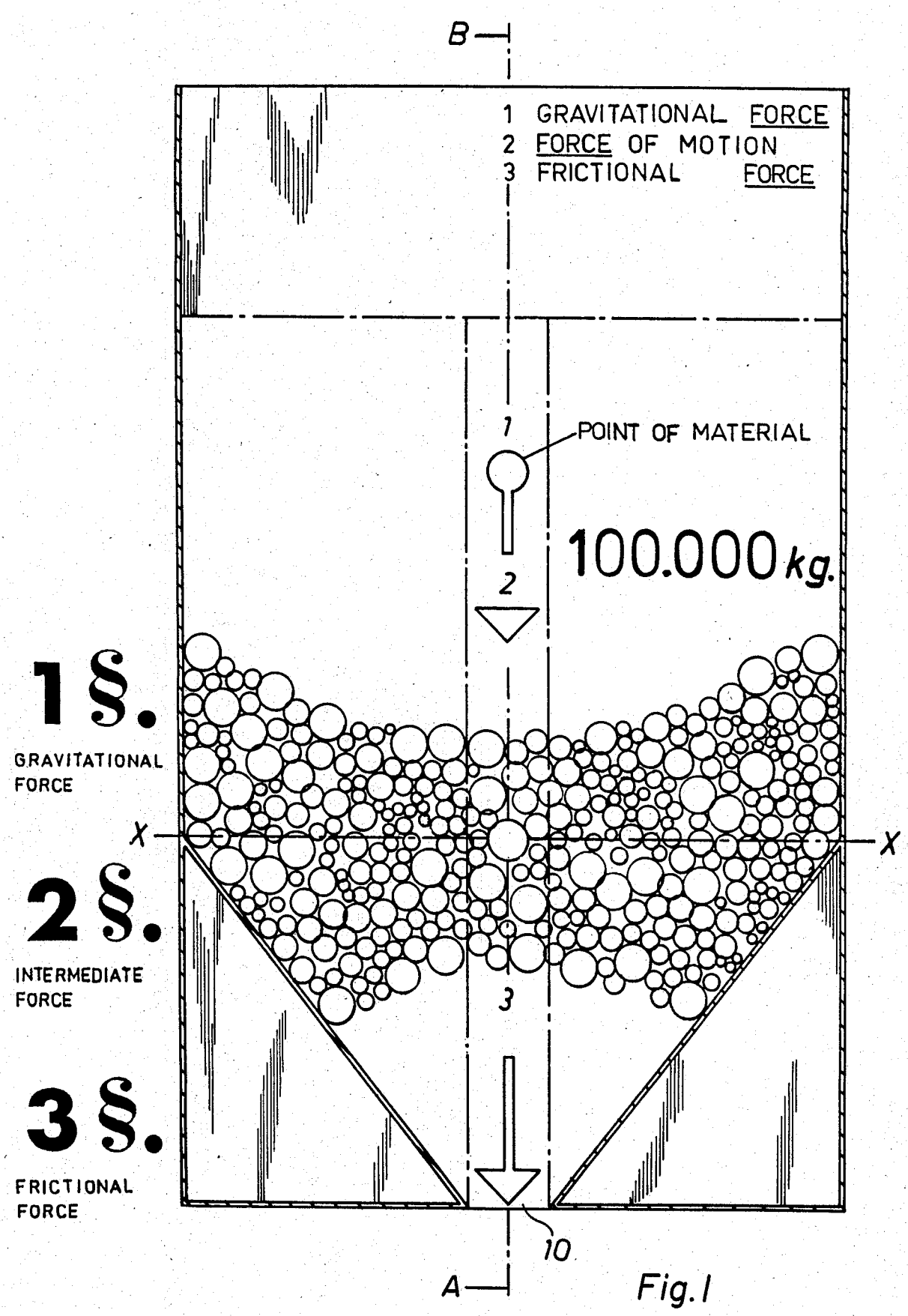
FIG. 1 shows a silo in vertical section for studying the motion of a point of material positioned on a vertical running through the center of a trickling outlet and FIG. 2 is a vertical section of a silo fitted with friction plates in accordance with the invention.

Referring to FIG. 1, the bottom section of a vertical, e.g. cylindrical silo is provided with a trickling funnel which in a flat-bottomed silo consists of petrified rock material but which, in practice, is made of sheet metal for lower friction.

Figure 2:
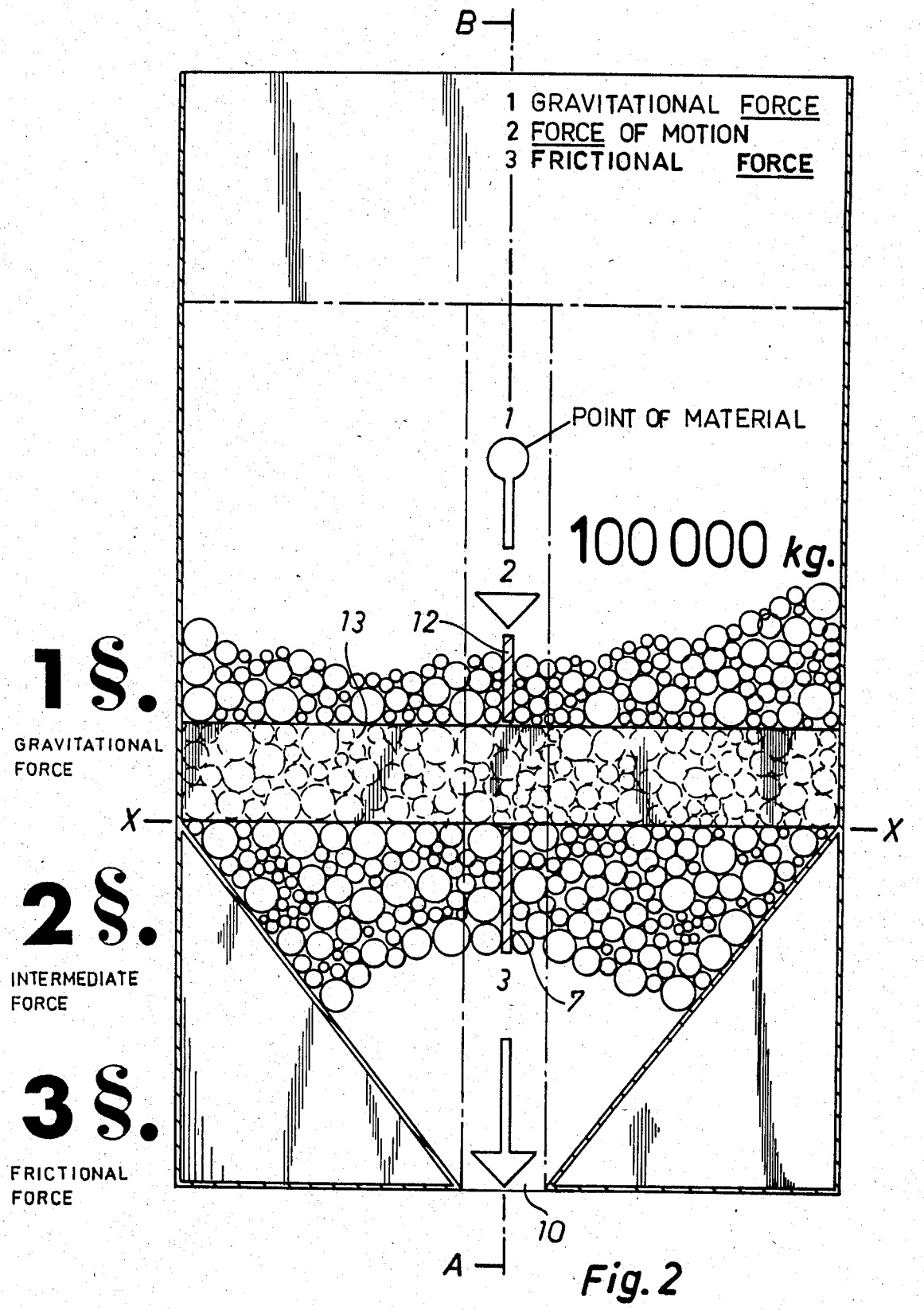

The vertical A-B extending through a silo trickling outlet is a so-called Newton power line along which the linear motion of a point of material occurs. In the race between a point of material on this vertical and the rest of a siloed material, the point of material always beats the siloed material. Unless this is the case, the siloed material does not trickle. This can also be verified by means of sensory perception. As the siloed material trickles, a point of material is in uniform and linear motion along vertical A-B. Thus, frictional force is one of the requirements for the uniform and linear motion of a point of material. However, the frictional force between the point of material and the siloed material may not increase with respect to gravity in a manner that an intermediate force or kinetic force would disappear. In order to eliminate this increased frictional force, as shown in FIG. 2, a vertical extending through a trickling outlet 10 is provided with upright friction plates 7, 12, 13. The connection point between the top section of an effluence cone and the bottom section of a silo is designated as X-X. At the intersection between the axes X-X and A-B, the frictional force between a point of material and is a siloed material at its greatest. It is in this area where the increase of frictional force between the point of material and siloed material must be stopped. This is why friction plates 7, 12, 13 are positioned in the top section of an effluence cone and in the bottom section of a silo. In a silo, the friction plates may of course extend up to a desired level.

Figure 3:
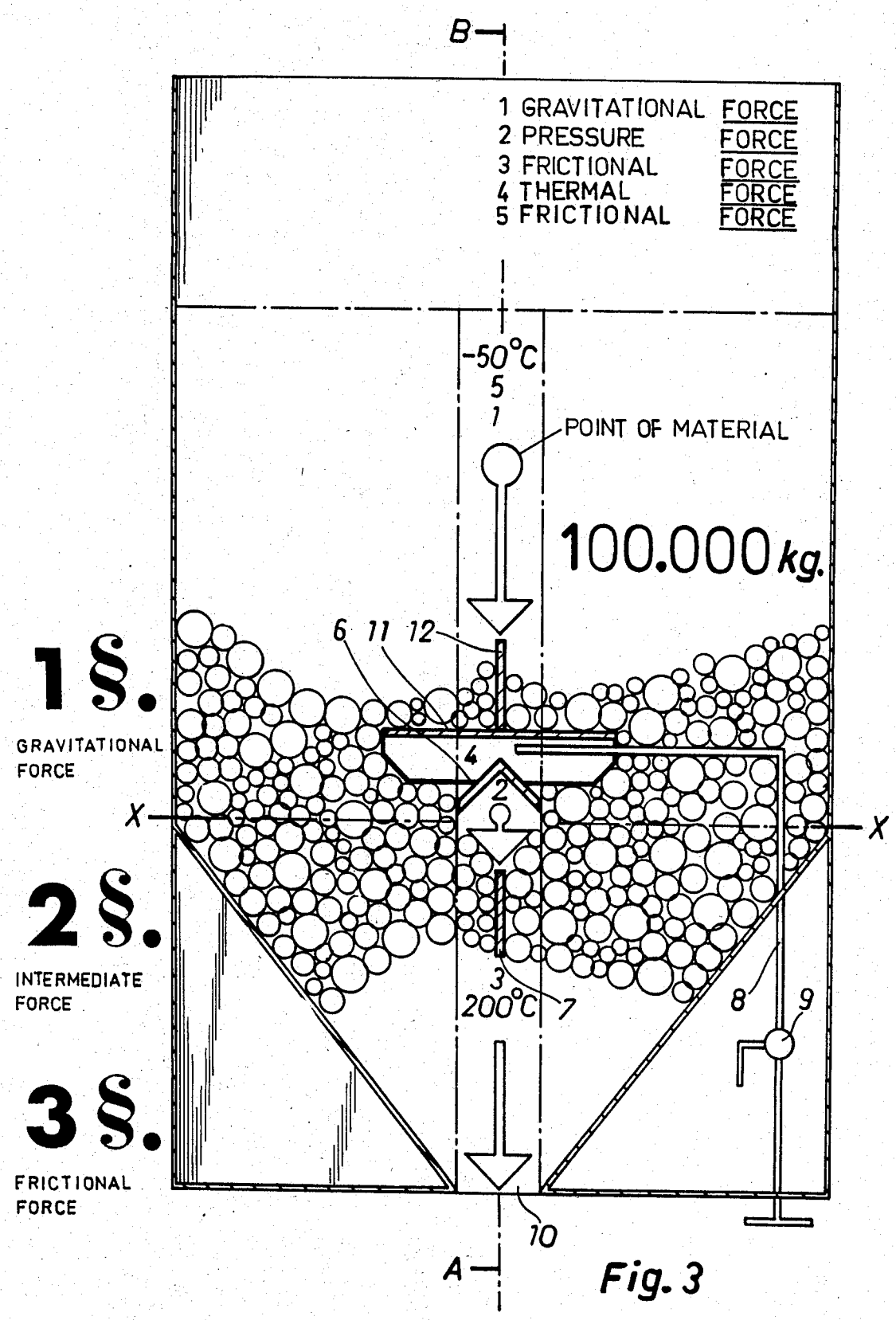
FIG. 3 is a vertical section of a silo fitted with an assembly for carrying out a method according to a further development of the invention.

One preferred embodiment of the invention will now be described with reference made to FIG. 3, said embodiment being used when frozen rock material should be melted and/or heated for the production of hot concrete.

Above the trickling or draining outlet 10, the top end of a trickling funnel comprises a vaulting element 6 extending across a silo, the superatmospheric pressure being generated in a 2 space below said vaulting element 6 by means of a blower (not shown). The silo is more or less filled with rock material. Gravity of the silo-filling material is e.g. 100.000 kg. The pressure force exerted by the air in a space below vaulting element 6 depends on the surface area of the vaulting element and the pressure applied.

The frictional force relative to the siloed material can be greater than gravity and pressure force put together. Thus, the rock material does not drain out of the draining outlet. To overcome this problem, there is fitted between vaulting element 6 and draining outlet 10 a friction plate 7 which is aligned with the direction of action of pressure force and which eliminates the frictional force relative to the siloed material, so all materials in the silo can be urged down through the draining outlet.

Immediately above the vaulting element there is fitted a second vaulting element 11 with a steam line 8 opening therebelow, one end of the line being connected to a steam generator (not shown). The steam line is fitted with a valve 9 which is opened and closed only when the air blower is turned on, so that the discharge of steam would always take place into a pressurized space.

Temperature of a siloed material can be tens of centigrades below zero. Temperature of the air acting on the siloed material is e.g. 100° C. The pressure force of the air is e.g. 1.5 at (1.5 kg/cm$^2$), i.e. 28,875 kg when the surface area of the vaulting element is 19,250 cm$^2$. Temperature of the steam acting on siloed material is e.g. 200° C. and thermal power of the steam is 15 at (15 kg/cm$^2$), i.e. 280,750 kg. However, this thermal power disappears as it converts into kinetic energy and into the temperature of a siloed material. Thus, a friction plate 7 aligned with the direction of gravity and the pressure force is necessary for the reason that, as the moisture or water content of a siloed material increases, the frictional force relative to the siloed material always becomes greater than the gravity of a siloed material and the pressure force of air blow put together.

It is now possible to eliminate the frictional force above the X-X axis since the frictional force below the X-X axis has been eliminated first, meaning that the increase of gravitational draining action is useful. For this end, the silo is fitted above the vaulting element 11 with another friction plate extending substantially in the direction of gravity. The friction plate or plates extending in the direction of gravitational action can be built up to the top section of a silo, either parallel or crosswise to each other.

The above-described assembly embodies an essential, previously unknown force method principle which is that all trickle-promoting additional forces (in addition to gravity 1) are concentrated on a vertical extending through the draining outlet.

With the method and apparatus of the invention it is possible, without any trickling problems, to press all siloed materials, especially fine siloed materials and so-called filler, out through the draining outlet as a hot silo material.

I claim:

1. A silo comprising a vertical cylindrical bottom section for receiving-siloed material;

a trickling funnel disposed in said bottom section and having a centrally disposed outlet for the received material;

a first vaulting element extending across said bottom section and above said funnel, said vaulting element being aligned vertically above said outlet;

a friction plate vertically disposed between said vaulting element and said outlet;

means for generating a super atmosphere pressure in a space below said vaulting element; and means for passing a flow of steam into the space below said vaulting element.

2. A silo as set forth in claim 1 which further comprises a second vaulting element above said first vaulting element and said means for passing a flow of steam includes a steam line opening into a space below said second vaulting element.

3. A silo as set forth in claim 2 wherein said steam line opens adjacent to a central vertical axis of said outlet.

4. A silo as set forth in claim 1 wherein said first vaulting element and said friction plate are disposed on a common vertical axis passing through said outlet.

5. A silo as set forth in claim 1 wherein said means for generating super atmospheric pressure is an air blower.

6. A silo comprising a vertical cylindrical bottom section for receiving siloed material;

a trickling funnel disposed in said bottom section and having a centrally disposed outlet for the received material;

a first friction plate vertically disposed within said funnel above said outlet; and a second friction plate vertically disposed above said funnel and within a top part of an effluence cone.

7. A method of trickling and heating material in a silo having a funnel with a centrally disposed outlet comprising the steps of positioning a vaulting element above the funnel to define a chamber;

charging said chamber with pressurized air; and passing a flow of hot vapor into said chamber to heat the material therearound.

8. A method as set forth in claim 7 which further comprises the steps of positioning a vertical friction plate above the funnel outlet to concentrate the trickling forces on a vertical axis passing through the funnel outlet and directing a pressure force and a thermal force to said vertical axis.

9. A method of trickling material from a silo having a funnel with a centrally disposed outlet, said method comprising the steps of positioning a friction plate vertically within a top section of an effluence cone above the funnel and on a vertical axis through the outlet;

positioning a second friction plate vertically within the funnel in a bottom section of the silo and along said vertical axis; and causing the material to move with a linear motion along said plates under gravity.

* * * * *